United States Patent [19]

Poulsen

[11] 4,217,959

[45] Aug. 19, 1980

[54] ELECTRICALLY CONTROLLED FLUID DISPERSER FOR A FIRE EXTINGUISHING SYSTEM

[75] Inventor: Søren B. Poulsen, Skovlunde, Denmark

[73] Assignee: GW-Sprinkler A/S, Skodsborg, Denmark

[21] Appl. No.: 952,596

[22] Filed: Oct. 18, 1978

[30] Foreign Application Priority Data

Oct. 20, 1977 [SE] Sweden ..... 7711811

[51] Int. Cl.[2] ..... A62C 37/18

[52] U.S. Cl. ..... 169/28; 169/39; 169/61

[58] Field of Search ..... 169/28, 37–41, 169/58, 61; 222/5

[56] References Cited

U.S. PATENT DOCUMENTS

| | | | |
|---|---|---|---|
| 761,221 | 5/1904 | Grinnell | 169/37 |
| 3,597,780 | 8/1971 | Coyle | 222/5 X |
| 3,811,511 | 5/1974 | McCulloch | 169/41 X |

FOREIGN PATENT DOCUMENTS 1399749 7/1975 United Kingdom .

*Primary Examiner*—Robert J. Spar
*Assistant Examiner*—Fred A. Silverberg
*Attorney, Agent, or Firm*—Fleit & Jacobson

[57] ABSTRACT

This invention relates to a fluid disperser for a fire extinguishing system, and is specifically related to such kind of fluid dispersers which are adapted for electrical remote control. Such dispersers are provided with a striking mechanism adapted for breaking a safety device which closes the outlet for the fluid. The object of this invention is to show a construction by which it is ensured that the safety device is always fractured even by the use of a relatively weak striking mechanism and it is further the purpose of this invention to ensure that the path for the extinguishant is kept free after the fracturing of the safety device. For this purpose a displaceable striking pin and a loose counter-rest is used in connection with the striking mechanism so that the striking pin and the counter-rest will fall down as soon as the safety device is fractured thereby leaving the desired free passage for the extinguishant.

7 Claims, 2 Drawing Figures

ELECTRICALLY CONTROLLED FLUID DISPERSER FOR A FIRE EXTINGUISHING SYSTEM

BRIEF SUMMARY OF THE INVENTION

The invention relates to a fluid disperser for a fire extinguishing system, the disperser having a body part with an outlet orifice for extinguishant, a frangible safety device closing said orifice, said safety device being secured between the orifice and a baffle plate disposed in alignment of said orifice and retained by two retainers secured to the body part, an electrically controlled striking mechanism for momentary fracturing the safety device being disposed adjacent the safety device in a first holder outside the path of the extinguishant. Such fluid dispersers are intended for being actuated from an actuator not mounted on the fluid disperser itself, for example remote control installation or a specific electric sensor. As the whole fluid disperser should preferably take up as little space as possible, also the striking mechanism must be comparatively small, for which reason the effect of the strike will be limited. At the same time it is very important that the fluid disperser is constructed in such a way that the dispersive function in no way is impeded by the additional devices which must be mounted in connection therewith.

The object of the present invention is to disclose a fluid disperser which not only gives the desired optimum dispersion of the extinguishant, under all conditions, but simultaneously also ensures absolutely that the frangible safety device is affected by a force sufficient to fracture the device even by using a relatively weak striking mechanism. This is achieved according to the invention in that a striking pin is slidably inserted in said first holder between the striking mechanism and the safety device abutting said safety device, whereas a further holder is disposed outside the path of the extinguishant diametrically opposite the said first holder relatively to the safety device, and a counter-rest being held in abutment with the safety defice by means of a screw which is secured into said further holder.

By such a construction of the fluid disperser the use of the above counter-rest ensures absolutely that even a relatively weak strike will be sufficient to facture the safety device, as it has no possibility of displacement as would have been the case without such a counter-rest, and at the same time both the counter-rest, safety device and the displacable striking pin itself will become completely free as soon as the safety device has been fractured and will therefore fall down and clear the path of the extinguishant so that the extinguishant hits the baffle plate in the desired manner and thereby fully achieves the dispersion aimed at. Functionally, this simple arrangement thus ensures absolutely the actuation as well as the dispersion of extinguishant.

The mounting of the striking mechanism may be carried out separately by means of special holders attached to the fluid disperser, but according to the invention it is furthermore expedient that said holders for the striking mechanism and counter-rest are constituted by the retainers supporting the baffle plate, whereby a simplification of the construction of such fluid dispersers is achieved which are manufactured with a direct view to the employment of the present invention.

The frangible safety device may be of any type, but according to the invention it is expedient that the safety device is temperature sensitive so that the fluid disperser will be actuated not only by direct heating, but electrically by means of the co-operation of the above striking mechanism with the frangible safety device. A particularly expedient embodiment of such a fluid disperser is characterized according to the invention in that the safety device consists of an empty or fluid-filled glass bulb of the type used for ordinary dispersers.

BRIEF DESCRIPTION OF THE DRAWING

The invention will be described in greater detail below in connection with the drawing where.

DESCRIPTION OF THE PREFERRED EMBODIMENTS

Figure 1:
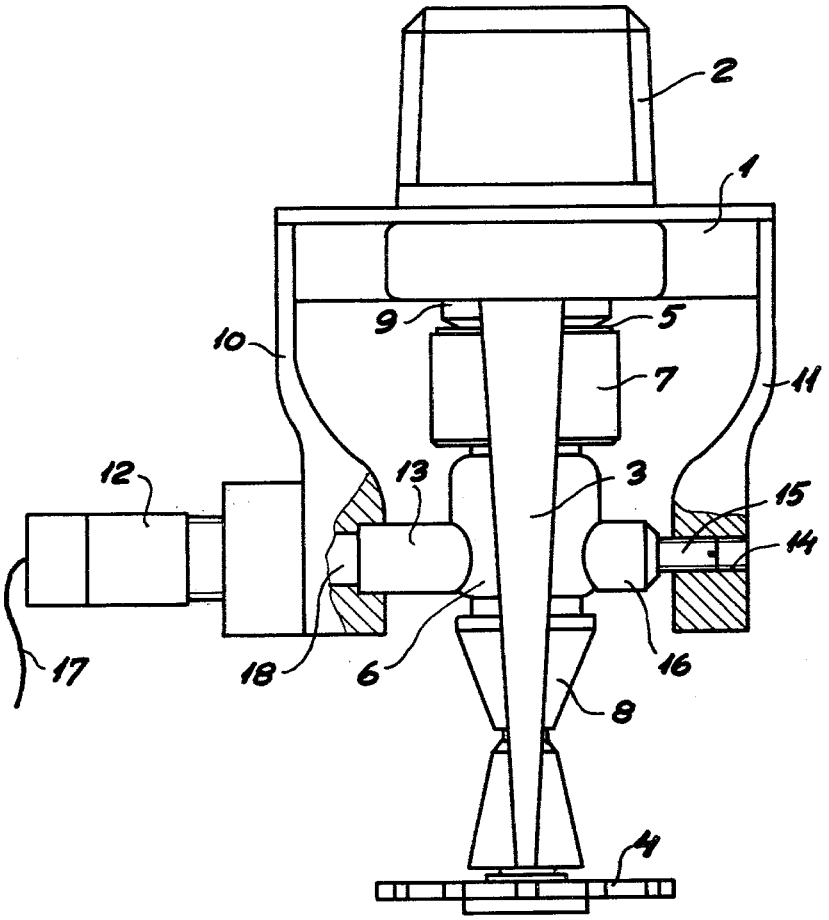
FIGS. 1 and 2 show two different embodiments of a fluid disperser according to the invention, both seen from the side.

FIG. 1 shows a fluid disperser for fire extinguishing systems and which consists of an upper part 1 with a threaded bushing 2 for screwing into an extinguishant supply pipe. From the upper part two retainers 3 extend which at the bottom support a baffle plate 4 of the usual, known type. The outflow of the extinguishant is prevented by means of a valve plate 5 kept in place by means of a frangible safety device 6, which by means of loose spacers 7 and 8 above and below the safety device 6, respectively, is firmly fixed between the baffle plate 4 and the extinguishant orifice 9 of the upper part.

To the upper part 1 two holders 10 and 11 are attached which are situated outside the path of the extinguishant from the extinguishant orifice 9 to the baffle plate 4 and of which the holder 10 supports a striking mechanism 12 and a striking pin 13 bearing against the safety device 6. The other holder 11 is provided with a bore 14 into which an adjusting screw 15 is screwed which again rests against a loose counter-rest 16 bearing against the safety device 6.

The striking mechanism may be of any type, but will often be of the type containing a small explosive charge which is actuated electrically and on the drawing a lead is shown which is connected to the striking mechanism 12 and by feeding an electric pulse through this lead 17 a release of the striking mechanism is achieved which may either be in the form of a small explosion or may be a release of a spring mechanism, and whereby the striking end 18 of the striking mechanism hits against the striking pin 13 and thereby causes the safety device 6 to be fractured. It will readily be understood that as soon as the safety device 6 has been fractured, the spacers 7 and 8, the striking pin 13 and the counter-rest 16 will fall down so that the path of the extinguishant to the baffle plate 4 is completely free.

Figure 2:
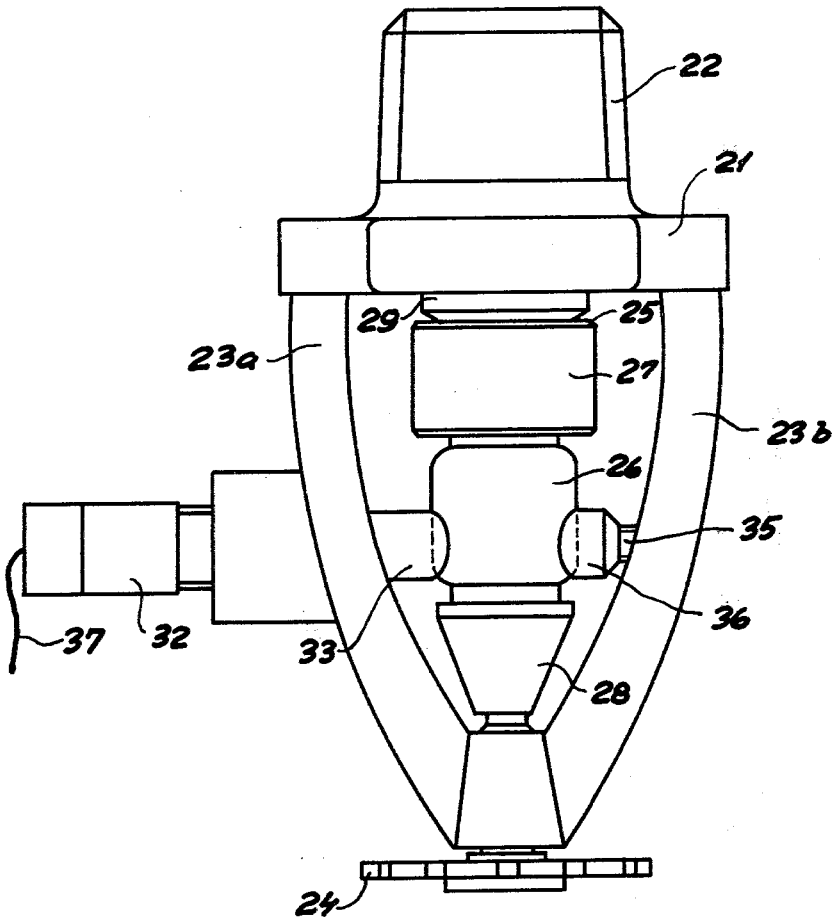

FIG. 2 shows an amended embodiment consisting of an upper part 21 with a screw bushing 22 and retainers **23*a* and 23*b* extending downwards from the upper part 21 and supporting a baffle plate 24. A valve disc 25 closes the outlet orifice of the upper part at 29 and is kept in place by a frangible safety device 26 and spacers 27 and 28. The striking mechanism 32 with the electric lead 37 is mounted in the retainer 23*a* which thus is serving as a holder for said mechanism corresponding to the holder 10 in FIG. 1. The retainer also contains a striking pin 33 corresponding to the striking pin 13 in FIG. 1. A screw 35 is placed in the other retainer 23*b* corresponding to the screw 15 in FIG. 1 and this screw holds firmly a counter-rest 36 for abutment against the safety device 26. The function of this fluid disperser is quite the same as the one described above in connection with FIG. 1, the only difference being that this embodiment is somewhat more simple, while the embodiment in FIG. 1** is preferably intended for use in connection with already existing fluid dispersers, where it is desired to add such an actuator as the one described in the application.

What I claim is:

1. A fluid disperser for a fire extinguishing system, the disperser having a body part with an outlet orifice for extinguishant, a frangible safety device closing said orifice, said safety device being secured between the orifice and a baffle plate disposed in alignment with said orifice and retained by two retainers secured to the body part, an electrically controlled striking mechanism for momentary fracturing the safety device being disposed adjacent the safety device in a first holder outside the path of the extinguishant, and wherein a striking pin is slidably inserted in said first holder between the striking mechanism and the safety device and abuts said safety device, said pin being inserted in said first holder in such manner that said pin falls out of said first holder upon fracturing of said safety device, whereas a second holder is disposed outside the path of the extinguishant diametrically opposite the said first holder relatively to the safety device, and a counter-rest being held in abutment with the safety device by means of a screw which is secured into said second holder.

2. A fluid disperser according to claim 1, and wherein said retainers comprise said first and said second holders for the striking mechanism and the counter-rest, respectively, and support the baffle plate.

3. A fluid disperser according to claim 1, and wherein the safety device placed between the striking pin and the counter-rest is temperature sensitive.

4. A fluid disperser according to claim 1, and wherein the safety device comprises an empty glass bulb.

5. A fluid disperser according to claim 1, and wherein the safety device comprises a fluid-filled glass bulb.

6. A fluid disperser according to claim 1, wherein a first spacer is disposed between said safety device and said outlet orifice and a second spacer is disposed between said safety device and said baffle plate, said first and said second spacers falling away from said outlet orifice and said baffle plate upon fracturing of said safety device.

7. A fluid disperser according to claim 1, wherein said couter-rest falls away from said second holder upon fracturing of said safety device.

* * * * *